United States Patent [19]

Nakagawa

[11] 4,348,861

[45] Sep. 14, 1982

[54] JEWELRY CHAINS BY ELECTRO-FORMING

[75] Inventor: Shigesaburo Nakagawa, Ichikawa, Japan

[73] Assignee: Nakagawa Corporation, Tokyo, Japan

[21] Appl. No.: 79,996

[22] Filed: Sep. 28, 1979 (Under 37 CFR 1.47)

[30] Foreign Application Priority Data

| | | | |
|---|---|---|---|
| Mar. 29, 1978 | [JP] | Japan | 53-36385 |
| Mar. 31, 1978 | [JP] | Japan | 53-37935 |
| May 18, 1979 | [JP] | Japan | 54-66678 |

[51] Int. Cl.[3] ..... A44C 11/00

[52] U.S. Cl. ..... 59/82; 59/3; 59/35 R; 63/4; 204/28

[58] Field of Search ..... 59/78, 80, 82, 90, 3, 59/35 R, 1; 204/18.1, 24, 22, 28, 199; 63/4

[56] References Cited

U.S. PATENT DOCUMENTS

| | | | |
|---|---|---|---|
| 2,711,069 | 6/1955 | Armbrust | 59/80 X |
| 3,416,306 | 12/1968 | Nakagawa | 59/80 |
| 3,453,185 | 7/1969 | Nakagawa | 204/24 |

*Primary Examiner*—Mark Rosenbaum

*Attorney, Agent, or Firm*—Armstrong, Nikaido, Marmelstein & Kubovcik

[57] ABSTRACT

The invention relates to jewelry chains by electro-forming wherein a jewelry chain as an original material is thickened by an electro-forming to obtain fattened chain links thereof such that the fattened chain links not only make the distance between interlinked pivotting points of each chain link of the chain relatively smaller to make the chain in a denser construction but also adapt the chain for subsequent various processes such as pressing, swaging and the like to obtain more novel chains in design and style. Further, it relates to an apparatus suitable for the electro-forming process.

7 Claims, 58 Drawing Figures

FIG. 24(a) chain link. 1
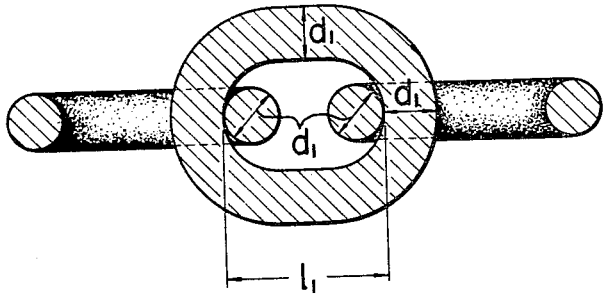
FIG. 24(b) chain link. 2
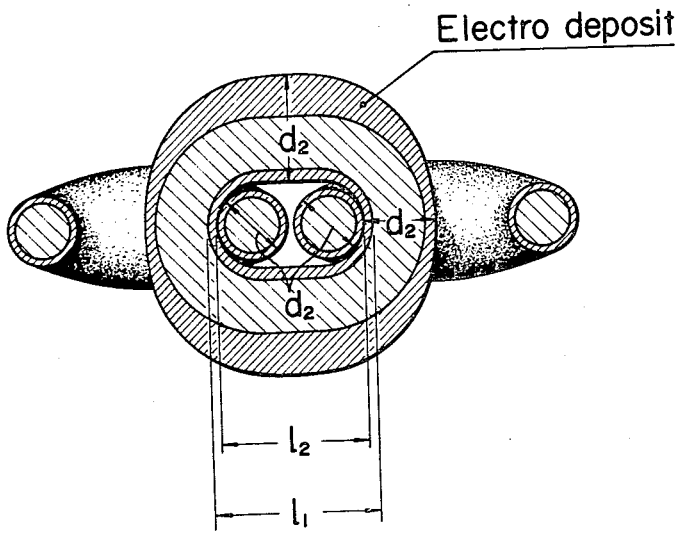

JEWELRY CHAINS BY ELECTRO-FORMING

BACKGROUND OF THE INVENTION

1. Field of the Invention

The invention is directed to thickening chain links interlinked to one another of a chain uniformly and to any thickness by means of an electro-forming and therefore producing various chain products efficiently and economically. Further, the thickening of the chain links by means of the electro-forming makes the distance between interlinked pivotting points of each chain link relatively smaller to make the chain in a denser construction per an unit length and the thickening of the chain links serves as a preliminary process before subsequent processes such as cutting, filing, stamping, pressing, swaging, etc. to obtain more novel and sophisticated chains in design.

2. Description of the Prior Art

The manufacture and kind of jewelry chains

There are very many kinds of various types of jewelry chains used for necklaces, etc., which are roughly classified into machine-made and hand-made chains. The machine-made chains are continuously produced by being formed and linked from a wire or a strip by an automatic chain making machine designed and adjusted specifically as required, while the hand-made chains are made generally by linking the links by hand one by one although some constituents of the links can be made by automatic machines. In this connection it should be noted that the latter process is seen more often in precious metal chains while the former process is used with brass to produce chains for costume jewelries.

Limit of the Machine-made Chains

The machine-made chains can be made in quantities and thus economically, though they naturally have their own technical limits in design and style unlike the hand-made chains. One of the most difficult chains to make by machine is one of a very dense construction which gets more difficult to make if the chain is finer. It is partly because a considerably sufficient space is required in the chain link in order to mechanically perform the process of interlinking chain links without trouble when a mechanical accuracy possible to employ today is considered.

Swaging Process

At present, the only method to make a chain of dense construction almost like a solid metal cord automatically and continuously to some extent is a process that is generally called "Swaging" in this trade; to continuously let the chain made by machine pass between some pressing dies with grooves of an appropriate section to strongly compress the chain to a form and then make a slight gap between the chain links bitten each other by repeating to bend it by such means as forcing the chain to pass between multiple rolls after softening its material by such means as annealing, and thus giving a minimum flexibility (or limberness) necessary to use for necklaces and the like to the chain of which each links deformed and bitten each other to fill the spaced along the length of the chain by the pressure from the directions of its side.

Relations between the swaged chain and soldering

The above described swaging process can be applied to many kinds of the machine-made chains. However, if the joints of the chain links are not soldered, the chains are weak and easily broken since the joints of the chain links are apt to be opened with a slight excessive bending power applied. Therefore, chains of higher quality or finer sizes must be soldered stronger than usual before swaging. The reason why a special strength is required is because the chain breaks during the processes of such strong compression and deformation including the subsequent so-called limbering process unless it is strong enough to get through those procedures.

It is however still understood as technically very difficult to perform soldering on these chains automatically and continuously and still getting a strength needed for swaging without fail. The present level of the art is that producing a considerable amount of defected chains during these swaging and limbering processes still cannot actually be avoided.

Flexibility of the swaged chain

Jewelry chains generally are required to be supple and smoothly bent. Since the flexibility of swaged chain is an accumulation of the limited freedom of each link acquired from a slight gap between the chain links compressed and deformed to bite each other, if a chain has more links in an unit length, in other words, of which the distance between the interlinking points is shorter, this accumulation becomes larger, that is, more flexible becomes the chain, if the structure of the chain link is same. Therefore, a chain to be swaged generally is required to provide its distance between interlinking points as short as possible while it is limited in case of the machine-made chain for the reason already described. For instance, in case of a fine cable chain as indicated in FIG. 24(*a*) or curb chain (less than 1 millimeter in wire diameter) to show an example, around 2.5 times of the wire diameter is understood as the shortest possible. Though it still may be shortened in case of thicker chains, it is theoretically obvious that it cannot be shortened less than 2 times of the wire diameter. Furthermore, this distance may stretch in a considerable amount by the swaging process according to the structure of chain and how to crush it while it can be said to the contrary that there is little possibility for it to be shortened.

Design and Supplemental Processes of the Machine-made Chains

Design and variety should be the most important factors of jewelry chain as a merchandise. Therefore, the machine-made chains too are subjected to various subsequent processes also mechanically, automatically and continuously, in order to diversify designs and to give more sophisticated sense though they are also used in their original designs made by chain making machines. For example, it is being tried to cut with a diamond tool or grind with a grinding wheel continuously along the sides of the chain so that regularly shaped flat surfaces thus created be displayed along the sides or put a pattern to each links or modify them continuously by pressing with appropriate dies or twist them or properly combine these processes to create from an original, machine-made chain products of higher sense and more diversified designs. Even the swaging process may be included in this category as one of these subsequent processes. However, any of these processes are limited to making the chain lighter or thinner by removing a part of material or letting it stretch along the length of the chain to limit the degree of such processes. There is no method yet as far as the machine-made chains are concerned to positively thicken the chain continuously and uniformly to accommodate enough chain bodies for further modifying processes.

SUMMARY OF THE INVENTION

The inventor of this invention has examined from the knowledge and the expertise mentioned above a method to make a distance or a pitch between interlinking points of the respective chain links shorter compared with thickness of the chain, and discovered that a method of thickening chain links by electroforming is fit for the purpose.

Further, the inventor of this invention has conducted the research and experiments for this method of thickening chain links by electro-forming and found that the fattening of the chain links by electro-forming increases a tensile strength of the chain conspicuously and proposes a jewelry chain of more excellent flexibility by making interlinked pivotting points of each chain link relatively closer and further provides an advantage for subsequent processes especially in case of subsequent swaging processes; furthermore when a chain is fattened by the electro-forming process to a weight at least twice as heavy as compared with before the fattening even a chain of which links are not soldered gets a strength almost possible to complete with a chain of which links are soldered beforehand, thus providing possibility to eliminate soldering process; and also in case of a chain soldered beforehand to be used as material, strength of the chain increases to about twice.

Referring to FIG. 24(*a*), the distance ($l_1$) between interlinking points of the original chain links 1 usually is around $3d_1$ ($d_1$ is an original diameter of the wire which the chain links consist of) and cannot be less than $2.5d_1$ by mechanical methods as mentioned already. In other words, it is impossible to get a chain of such a dense construction as $l_1$ is less than $2.5\ d_1$ while after the same chain 1 is fattened about five times in weight per length, $l_2$ (the new distance between interlinking points) becomes $2d_2$ or less ($d_2$ is the new wire diameter in the average) constituting a chain of very dense construction compared with its thickness, impossible to make mechanically, because the wire diameter of the fattened links becomes $\sqrt{5}\ d_1=2.236d_1$ in the average, while the inside diameter of the links becomes even shorter due to some metal deposit.

Also, the distance between interlinking points of a chain tends to be stretched by the links deforming and biting each other longitudinally when the chain is subjected to the pressure from the side by being pressed or swaged, not only losing as much the extent of freedom of each chain link after limbered but also decreasing number of links per unit length, both to work against flexibility of the chain to be obtained. However, if this distance between interlinking points of chain links is shortened to the minimum compared with its thickness and the interlinking space in the chain links is filled enough, as indicated in order of fattening extension FIG. 24, from (*a*) to (*b*), such a chain not only has more number of links per unit length compared with its thickness but also does not stretch having no such space to fill, both working favorably for flexibility of the chain to be obtained.

The present invention has been developed on the basis of these results and is directed to a method of thickening a jewelry chain prepared by a conventional method with an ordinary interlinking distance by means of the electro-forming to make the chain thicker and heavier so that the distance between interlinked pivotting points of each chain link is made shorter compared with the thickness of the chain to obtain a chain enough flexible.

It is an advantage of the invented method of electroforming that the visible outer parts of a chain are thickened relatively thicker than the invisible overlapped parts at interlinked points. Another advantage lies in that a chain can be fattened to a desired thickness and the fattening extent is precisely adjustable by controlling the electric current and the processing length of time used for electroforming.

If a chain is thickened by moving the chain during the electro-forming process, the interlinked pivotting points relatively difficult to be electrodeposited are also thickened sufficiently so that the distance between the interlinked pivotting points is shortened and further such deposit to fill the spaces of the chain links limits the spaces to let the chain extend in the interlinking direction, thereby making the chain less deformable and affording a great advantage to the subsequent processes such as pressing, swaging and the like.

The thickening of chain links by electro-forming according to the invented method tends to greatly increase the strength of a chain. This tendency is displayed conspicuously until the chain is thickened to a doubled weight and after that quickly approaches a ceiling. This tendency also is utilized as fattening a chain. Through this thickening by electro-forming process, the joints of the chain links are strengthened irrespective to whether they are closed by soldering, eliminating in some cases the soldering process in the manufacture of chain. Further, in accordance with the invented method, this strengthening effect on the joints of the chain links together with the shortening effect on the distances between the interlinked pivotting points of the chain serves to prevent breakages and defective products during the subsequent processes such as pressing, swaging and the like.

Thus, the electro-forming process by the present invention is not only advantageously effective as a preliminary strengthening step before the subsequent processes such as swaging but also by itself makes it possible to manufacture chains of many styles and high decorative value.

In other words, while chains made by automatic chain making machines are naturally limited in their design and variety, this invention makes it possible that low-cost chains made by automatic chain making machines are thickened by electro-forming to a desired extent and freely modified to the chains of novel and sophisticated designs in many styles and kinds.

It is another object of this invention to provide an apparatus for carrying out the above stated thickening by electro-forming process on decorative chains.

Generally, long chains are plated by various methods which can be roughly divided into the following three modes: The chains are (1) bundled together for plating; (2) framed for plating; and (3) allowed to continuously pass through a tank.

The modes (1) and (2) are suitable for a thin plating such as an ordinary decorative plating, but not suitable for an electro-forming over a long period of time for obtaining an uniform thickening on a chain, because such methods tend to result in uneven parts. In the mode (3), the chains are allowed to continuously pass through a plating tank in the same manner as in plating a wire material. This method is suitable for production of the same kind of product in large quantity such as in the case of wire materials but is considered hardly suitable for production of varied kinds of products in rather small quantity such as in the case of decorative chains.

The apparatus of the present invention has been contrived in view of such situation. In the basic arrangement of the invented apparatus, a long chain or chains interconnected into a long line (hereinafter will be called a long chain alike) is wound in a state of many suspended loops around rotating cathode bars positioned over the surface of an electroforming bath within an electroforming tank the inside of which is provided also with anodes. The long chain is immersed in this electroforming bath while the loops of it are continuously forwarded in loops one after another to obtain a desired thickening effect. In carrying out this feeding operation, loops of the long chain are prevented from becoming uneven by nonconductive weight rods which are horizontally hung to rest on the lower ends of the loops so that the chain can be prevented from slipping off the cathode bars as the rotation of the cathode bars tends to cause the length of the chain loops to become uneven. Further, to ensure constant intervals between these loops in longitudinal directions of the cathode bars and the weight bars, there is provided a spacing means such as grooves or, protrusions along these bars.

In the invented apparatus, both the cathode bars and the weight bars which are disposed in the upper and lower positions are provided with the grooves or protrusions (or flanges) arranged as spacers as mentioned in the foregoing. The chain is hung in a hooked manner within the grooves or between the protrusions so that the spacing distance between one loop and another of the chain is kept same to keep the chain moving on the same path during the rotation of the cathode bars for attaining a uniform thickening effect.

Since the electroforming process is carried out by continuously forwarding the loops of a long chain in loops in a given direction in an endless manner or by continuously supplying the loops of a long chain from a coil and taking out the loops to another coil, or by reversing the rotation of the loops at given intervals or at every given length of time, the whole chain including the upper ends of the loops which are above the surface of the solution can be uniformly subjected to the electroforming process for exactly the same length of time. Further, since the chain is stretched by the weight bars the chain never slips off the cathode bars and there is no irregularity in the electric current. Besides, bending of the chain which takes place when it passes the cathode bars or the weight bars gives suppleness to the interlinked parts of the chain to prevent it not only from stiffening but also from having a bending tendency in a specific direction.

The use of the weight bars also serves to make uniform the thickening effect on the chain so that the chain can be prevented from being bent and kept in the normal direction even when the chain becomes shorter in an advanced stage of the thickening process. Further advantages of the invented apparatus include:

Since any rack to hand the long chain down into the bath is not required in accordance with the present invention, electro-forming can be applied with 100 percent efficiency without unnecessary deposit. Further, it is advantageous to carry out the thickening process by endlessly connecting both ends of the long chain or supplying the chain from a spool on one end and taking out the finished chain from the other end automatically and continuously and thus apply the electro-forming to the whole length of the chain.

It also is advantageous to make the turning cathode bars square-sectional so that it is effectively avoided that the chain so fattened may lack flexibility and slip. It also is effective to have an elastic matter such as a coil spring, a rubber ring, or the like set between long chains such that the distance between the turning bar and the weight bar can change elastically. Such arrangement effectively serves to maintain a constant tension of the long chain even when the distance set between interlinking points becomes shorter, in other words, the chain becomes shorter according to the progress of the electroforming process.

The above and other related objects and features of the invention will be apparent from the following description of embodiments thereof taken in connection with the accompanying drawings.

BRIEF DESCRIPTION OF THE DRAWINGS

FIGS. 20–23 are photographs of the chains corresponding to the Embodiments of FIGS. 6–19.

FIGS. 24(*a*)(*b*) are illustrations of a jewelry chain before and after thickening by electro-forming.

DETAILED DESCRIPTION OF PREFERRED EMBODIMENTS

Embodiment 1

Figure 1:
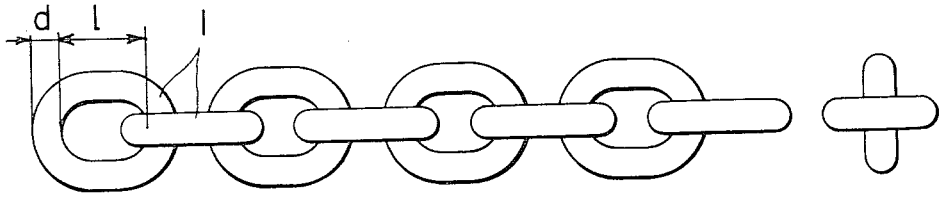
FIGS. 1(*a*), (*b*), (*c*) and (*d*) are front and side views showing a chain material of a jewelry chain of a simplest style usually called a cable chain in Embodiment 1 and its states of having been fattened by electro-forming to various degrees.
Figure 1:
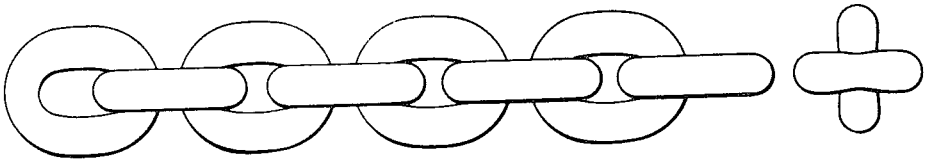
Figure 1:
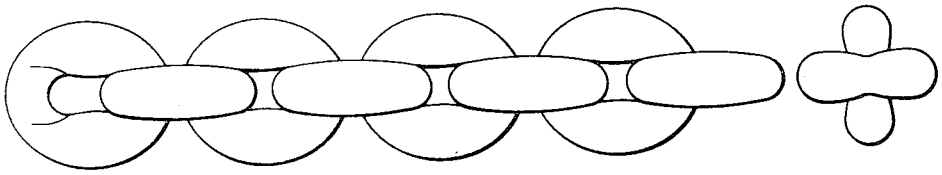
Figure 1:
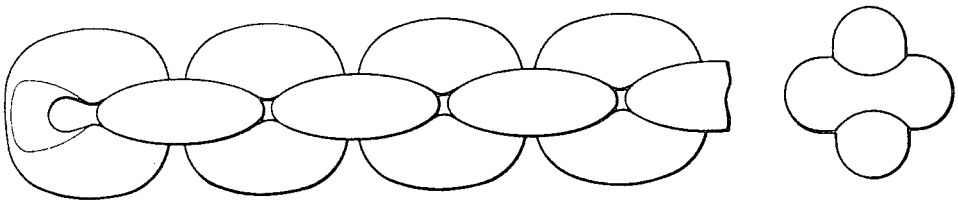
Figure 2:
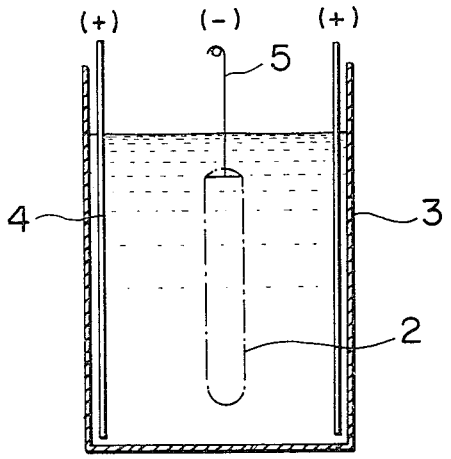
FIG. 2 is an illustration of an electro-forming apparatus.

A cable chain 2 brazed or not brazed which consists of ring shaped wire links or chain links, each link having inner diameter l measuring about 3 times as much as the diameter d of the wire as shown in FIG. 1(*a*), as a chain material, was subjected to the electroforming process by an apparatus as shown in FIG. 2. In FIG. 2, a reference numeral 3 indicates an electroforming tank containing a plating bath; 4 indicates a fixed anode; and 5 indicates a hooking rod which serves as cathode and also serves to hook the chain 2. The electroforming process was carried out under the following conditions:

| | |
|---|---|
| Composition of the plating bath: | 60 g/l of $H_2SO_4$ and 290 g/l of $CuSO_4$ |

-continued

| |
|---|
| Temperature: 28° C. |
| Current density: 1.5–2 A/dm$^2$ |

The products obtained by the electro-forming process were as shown in FIG. 1(*b*), 1(*c*) and 1(*d*).

Table 1 shows the results of the electroforming processes carried out on 50 cm of a cable chain material which was made of red brass wire (85 Cu—15 Zn) measuring 0.65 mm in wire diameter and was prepared without brazing the joints of links thereof. Table 2 shows the results of the same processes carried out for a chain material which was of the same kind but was brazed.

TABLE 1

| | When a chain material not brazed was used | | | | | |
|---|---|---|---|---|---|---|
| No. | Weight g | Multi-plied, times | * Strength kg | Rate of in-crease | Increase of strength kg | Wire dia., average |
| a | 5.07 | 1.00 | 1.7 | 1.0 | 0 | 1 |
| b | 10.20 | 2.01 | 8.0 | 4.7 | 6.3 | 1.42 |
| c | 15.35 | 3.03 | 10.0 | 5.9 | 8.3 | 1.73 |
| d | 25.30 | 4.99 | 12.0 | 7.1 | 10.3 | 2.24 |

Note: Asterisk indicates a tensile strength.

TABLE 2

| | When a brazed chain material was used | | | | | |
|---|---|---|---|---|---|---|
| No. | Weight g | Multi-plied, times | * Strength kg | Rate of in-crease | Increase of strength kg | Wire dia., average |
| a | 5.15 | 1.00 | 9.0 | 1.0 | 0 | 1 |
| b | 10.30 | 2.00 | 18.0 | 2.0 | 9 | 1.42 |
| c | 15.50 | 3.01 | 22.0 | 2.4 | 13 | 1.73 |
| d | 25.60 | 4.97 | 23.0 | 2.6 | 14 | 2.24 |

Note: Asterisk indicates a tensile strength.

Figure 3:
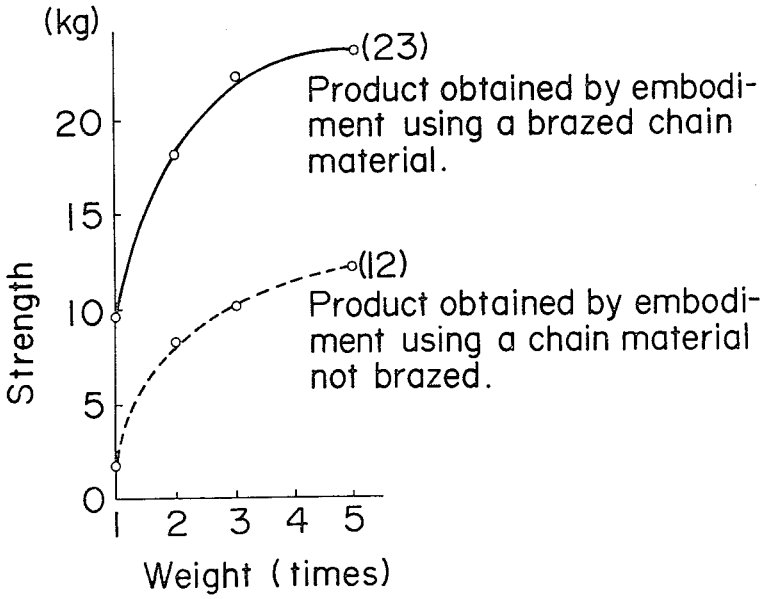
FIG. 3 is a graph showing fattening or thickening processes carried out in accordance with the present invention in relation to the strength of the chains subjected to the processes.

The relation of weight increase to increase in strength is as shown in FIG. 3, which indicates that the strength increases very sharply until the weight increases up to a weight twice as much and the rate of increase in strength slows thereafter.

When the chain not brazed was thickened by electroforming to the doubled weight, the chain not brazed being so fattened obtained almost the same strength as the brazed chain. In case of the brazed chain being subjected to the electro-forming process, the strength of the chain was almost doubled when the chain had been fattened to a doubled weight. Further, the fattening at each interlinking portion of the chain stopped when the sectional area had been increased up to more than double.

EMBODIMENT 2

Figure 4:
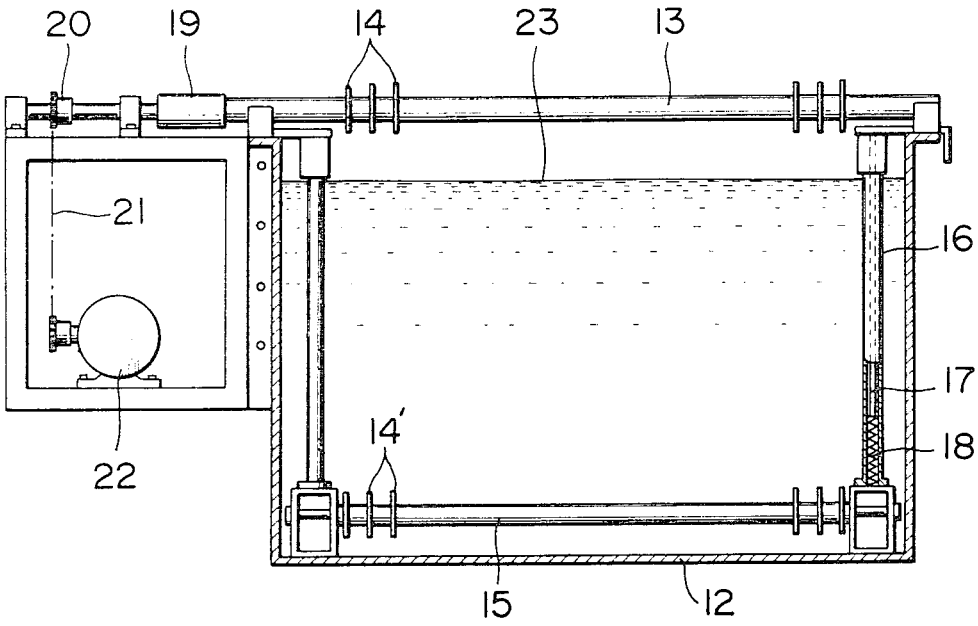
FIG. 4 is a front view of an electroforming apparatus as Embodiment 2 of the present invention.
Figure 5:
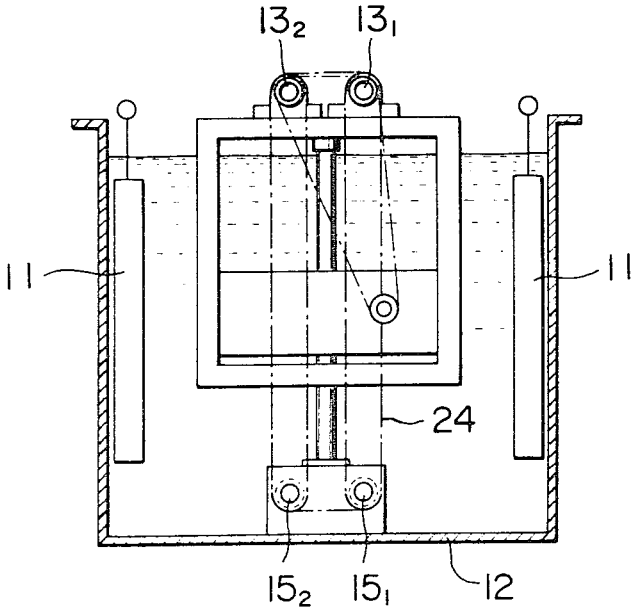
FIG. 5 is a side view showing the same apparatus.

Referring to FIG. 4 and 5, an electroforming tank 12 is provided with anodes 11 made of copper plates enclosed in titanium cases which are disposed on two inner sides of the tank 12. A pair of turning cathode bars 13 having a sectional shape of 30 mm square are detachably mounted on the electroforming tank 12 above the middle part of the tank. The cathode bars 13 are provided with vinyl chloride collars 14 and are spaced at equal intervals. A reference numeral 15 indicates a pair of nonconductive weight bars which are made of vinyl chloride pipes each measuring 20 mm in diameter with a weight iron core inserted therein. The weight bars 15 are also provided with collars 14 which are made of vinyl chloride and are equally spaced. On the bearing parts at both ends of the weight bars 15, there are provided guide pipes 16 which are made of vinyl chloride and rise perpendicularly to the weight bars. A guide rod 17 which is attached to the electroforming tank 12 is slidably inserted in each of the guide pipes through a spring 18 provided within the pipe. The guide rods 17 are thus arranged to somewhat lift up the weight bars 15 against the force of the spring 18.

Each of the cathode bars 13 is arranged to be rotatable by a motor 22 by means of a joint 19, a sprocket wheel 20 and a chain 21 which are disposed outside of the electroforming tank 12.

A reference numeral 23 indicates a liquid surface of an electroforming bath; and 24 indicates a long chain which is put around a first pair of a cathode bar $\mathbf{13}_1$ and a weight bar $\mathbf{15}_1$ to form a loop going from one end to the other in the leftward direction and then, at the other end, is continuously put around a second pair of a cathode bar $\mathbf{13}_2$ and a weight bar $\mathbf{15}_2$ to form a similar loop going from one end to the other end thereof. Then the long chain is again put around the first pair of the cathode bar $\mathbf{13}_1$ and the weight bar $\mathbf{15}_1$. In this manner, the long chain is put around the pairs of cathode bars and weight bars in an endless manner.

A simple fattening purposes can be effectively attained by the use of, for example, an ordinary electroforming bath which is mainly composed of copper sulfate. In cases where it is desired to impart a granular surface to the chain, the use of a cyanide bath which is composed of, for example, 80 g/l of cuprous cyanide, 7 to 10 g/l of free cyanide and 10 g/l of Rochelle salt to carry out electroforming over a period of one hour at 60° C. is effective. Normally, the electroforming process is carried out over a period of 1 to 3 hours or thereabout.

However, in accordance with the invention, no particular restrictions are put on the conditions of the electroforming bath. When a long chain material to be processed is made of brass or red brass, the use of a copper sulfate bath ($CuSO_4+H_2SO_4$) enables to obtain a highly malleable electroformed layer. In that case, the bath requires no additive. In an experiment, for example, an electro-forming bath composed of 290 g/l of $CuSO_4$ and 90 g/l of $H_2SO_4$ was used and electroforming was carried out at a temperature of 30° C. and a current density of 4 A/dm$^2$ to obtain an even and smooth thickening effect at a rate of 1.2 to 1.3 g/ampere-hour up to a considerable thickness.

It also should be noted that such preliminary treatments as degreasing, activating and so on and subsequent processes as rinsing and neutralizing, etc. should be performed before and after this electroforming process of a long chain as usual.

EMBODIMENT 3

The thickening electro-forming of this invention will be applied to various jewelry chains through the following detailed processes.

A basic process diagram is represented as follows:

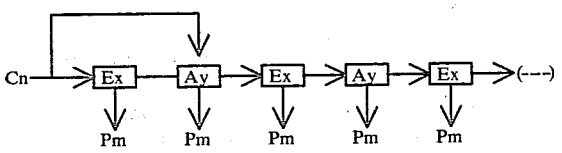

In the above process diagram, (----) after [Ay]→[Ex]→ indicates that the process of [Ay]→[Ex] can be repeated without limit. The definition of Pm, Cn, Ex and Ay is as below:

| | |
|---|---|
| Pm:; | products produced as the result. |
| Cn: | indicates an optionally original chain including all automatic machine made and handmade chains. n indicates its type and kind (for example, like indicating $C_1$ to show a cable chain of a standard dimension). |
| Ex: | indicates a thickening process by means of an electro-forming, x indicates a degree of the thickening. (For example, $E_{2.5}$ may indicate a chain to be thickened until it weighs 2.5 times heavier than before per an unit length). |
| Ay: | indicates any process to affect design and style of a chain link except the thickening process mentioned above. y indicates kind and combination, degree and sequence thereof. (For example, supposing that $A_1$ shows grinding and $A_4$ pressing, $A_4 + 1$ may show grinding after pressing). The process of Ay includes: continuous or intermittent pressing and swaging, engraving, patterning, deforming or cutting in part by means of press, rolls, rotary swaging machine or the like; overall or part grinding by means of a grinding stone; overall or part cutting or patterning by means of a cutter including a diamond tool; twisting; addition or joining entirely or partly of a part by means of brazing, caulking, etc.; braiding of plural chains; other parts of metal, plastic, glass or the like being connected at regular intervals and so on. |

The details of the example processes are described below.

EXAMPLE 1

A process corresponding to Cn→Ex→Pm is the most simplest process of the basic process diagram in which the electro-forming process is carried out on a cable chain as shown in FIG. 1(*a*) as an original chain and, as the result, chain products as shown in FIGS. 1(*b*), (*c*) and (*d*) are produced. These chain products are example products to this process.

EXAMPLE 2

Figure 6:
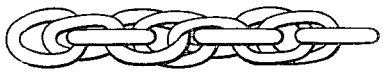
FIGS. 6–19 are illustrations of the jewelry chains of Embodiments.
Figure 6:
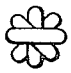
Figure 7:
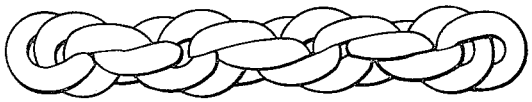
Figure 7:
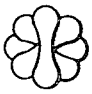
Figure 20A:
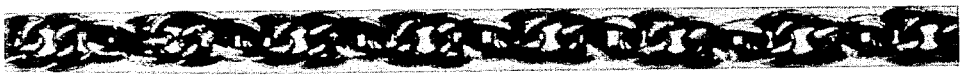
Figure 20B:
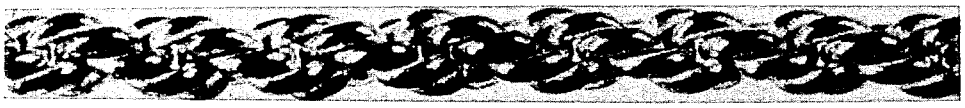

In a same process as in the example 1, the electro-forming process is carried out on a double cable chain as shown in FIGS. 6A and B, and FIG. 20A as an original chain, thereby obtaining chain products as shown in FIGS. 7A and B, and FIG. 20B.

EXAMPLE 3

Figure 8:
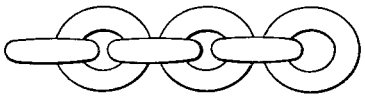
Figure 9:
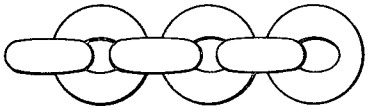
Figure 10:
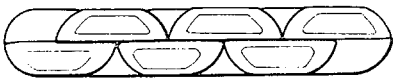
Figure 10:
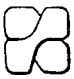
Figure 21A:
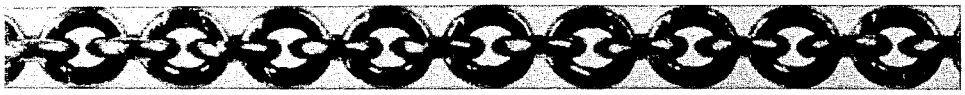
Figure 21B:
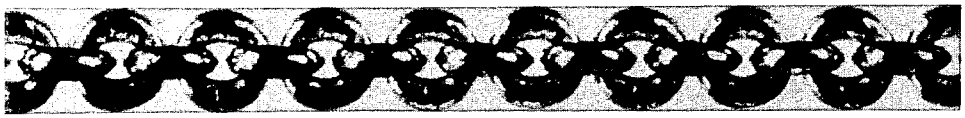
Figures 1, 21C:
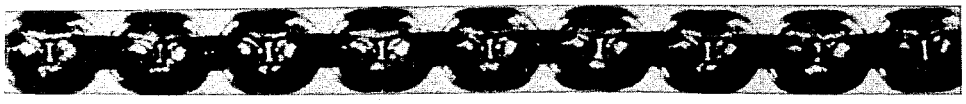
Figures 2, 21C:
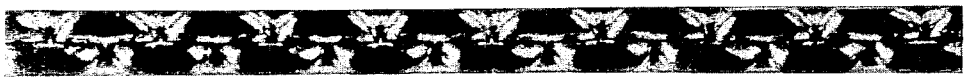

In a process corresponding to Cn→Ex→Ay→Pm of the basic process diagram, the electro-forming process is carried out on a cable chain as shown in FIG. 8 and FIG. 21A as an original chain to obtain fattened cable chains as shown in FIG. 9 and FIG. 21B and the fattened cable chains then swaged to a square shape to obtain chain products as shown in FIGS. 10A and B, and FIG. 21C.

EXAMPLE 4

Figure 11:
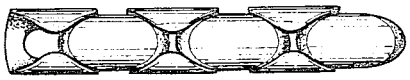
Figure 11:
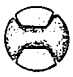
Figure 21D:
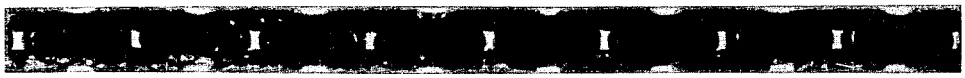

The chain products obtained in the example 3 are further swaged to a round shape to obtain chain products as shown in FIGS. 11A and B, and FIG. 21D.

EXAMPLE 5

Figures 12, 12A:
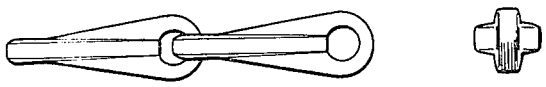
Figures 13, 13A:
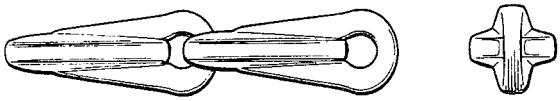
Figures 14, 14A:
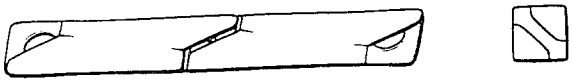
Figure 22A:
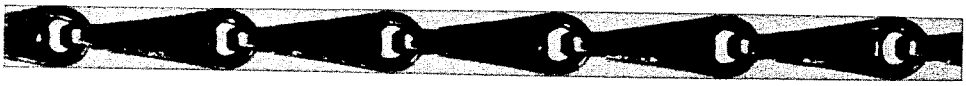
Figure 22B:
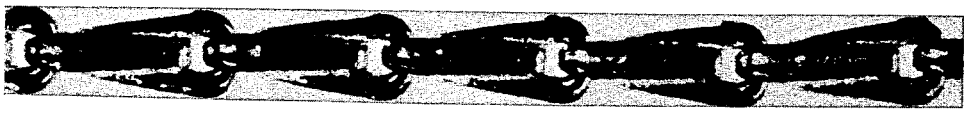
Figure 22C:
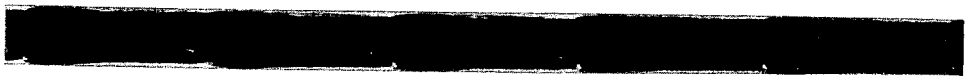

In a same process as in the example 3, the electro-forming process is carried out on a Barley corn chain as shown in FIGS. 12A and B, and FIG. 22A as an original chain to obtain fattened Barley corn chains as shown in FIGS. 13A and B, and FIG. 22B and the fattened Barley corn chains then swaged to obtain chain products as shown in FIGS. 14A and B, and FIG. 22C.

EXAMPLE 6

Figure 15:
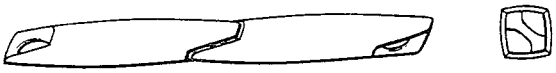
Figure 22D:
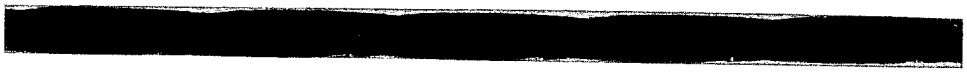

The chain products of the example 5 as shown in FIGS. 14A and B, FIG. 22C are further subjected to a cutting by means of a diamond tool to obtain chain products as shown in FIGS. 15A and B, and FIG. 22D.

EXAMPLE 7

Figure 16A:
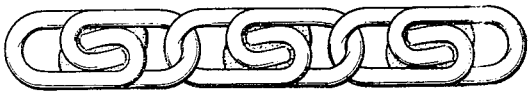
Figure 16:
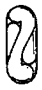
Figure 17:
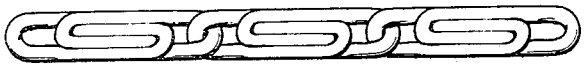
Figure 17B:
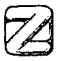
Figure 17:
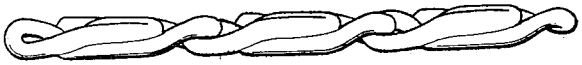
Figures 1, 23A:
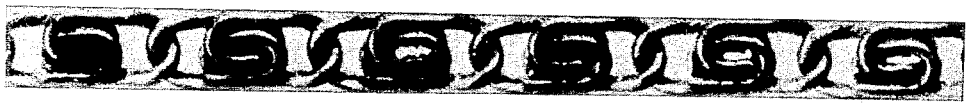
Figures 2, 23A:
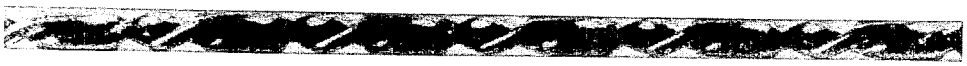
Figures 1, 23B:
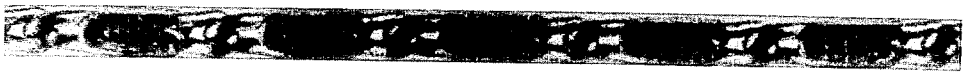
Figures 2, 23B:
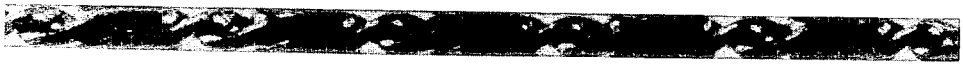

This process corresponds to Cn→Ay→Ex→Ay→Pm of the basic process diagram. In the process, S-curb chains as shown in FIGS. 16A and B, and FIG. 23A are swaged to a square shape to obtain modified S-curb chains as shown in FIGS. 17A, B and C, and FIG. 23B and these modified S-curb chains are then subjected to the electro-forming process to obtain chain products as shown in FIGS. 18A, B and C, and FIG. 23C.

EXAMPLE 8

Figure 18:
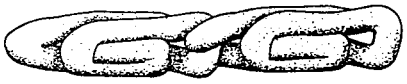
Figure 18:
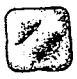
Figure 18:
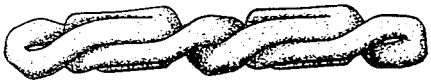
Figure 19:
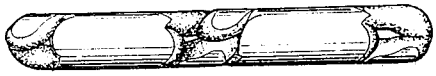
Figure 19:
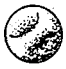
Figure 19:
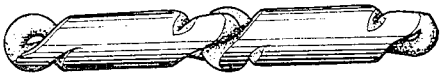
Figures 1, 23C:
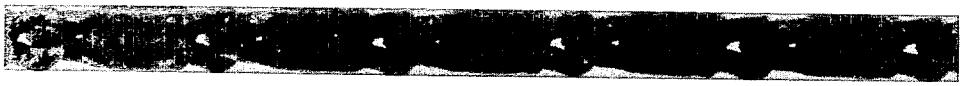
Figures 2, 23C:
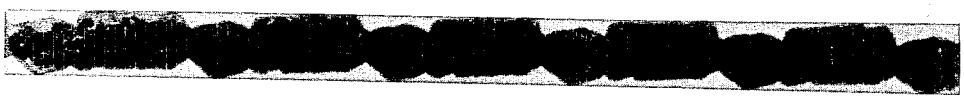
Figures 1, 23D:
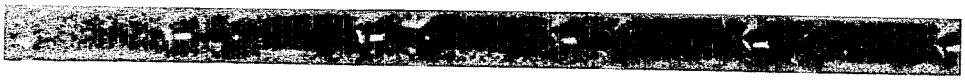
Figures 2, 23D:
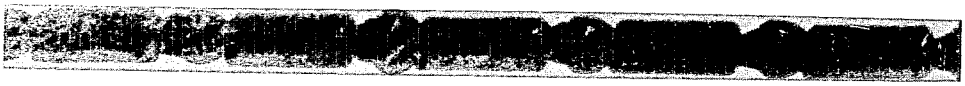

The chain products of the example 7 as shown in FIGS. 18A, B and C, and FIG. 23C are further swaged to a round shape to obtain chain products as shown in FIGS. 19A, B and C, and FIG. 23D.

What is claimed is:

1. A jewelry chain thickened by electroforming wherein a jewelry chain as an original material is smoothly thickened by electroforming in a bath containing copper sulphate and sulfuric acid at a temperature of about 30° C. to obtain a fattened chain link thereof such that a distance between interlinked pivotting points of each chain links of said chain becomes smaller in relation to thickness of said chain link thus produced to make the chain in a denser construction.

2. A jewelry chain thickened by electroforming as defined in claim 1 wherein a jewelry chain as an original material is brazed at a butt joint portion of each chain link of said chain and said brazed chain is thickened by electroforming, thereby increasing a strength thereof.

3. A jewelry chain thickened by electroforming wherein said fattened jewelry chain according to claim 1 is subjected to at least one subsequent process of pressing, swaging or the like.

4. A jewelry chain thickened by electroforming wherein, in each chain link of a jewelry chain formed of an overlapping portion and a remaining portion, the overlapping portion of a chain link formed by chain links interlinked with one another is smoothly thickened to a relatively thin thickness and the remaining portion of said chain link, except the overlapping portion, is smoothly thickened to a relatively thick thickness such that a distance between interlinked pivoting points of each chain link becomes smaller in relation to the thickness of said chain link thus produced, thereby making said chain in a denser construction.

5. A jewerly chain according to claim 4 which is obtained by processes comprising a thickening process carried out by electro-forming.

6. A jewelry chain according to claim 4 wherein each link is formed from a ring-shaped wire having abutting ends, and the abutting ends form a joint which is brazed prior to electro-forming.

7. A jewelry chain as defined in claim 4 wherein a jewelry chain as an original material is thickened by an electro-forming to obtain a fattened chain and said fattened chain is then subjected to at least one subsequent process of pressing, swaging or the like.

* * * * *

UNITED STATES PATENT AND TRADEMARK OFFICE

CERTIFICATE OF CORRECTION

PATENT NO. : 4,348,861

DATED: September 14, 1982

INVENTOR(S) : SHIGESABURO NAKAGAWA

It is certified that error appears in the above-identified patent and that said Letters Patent are hereby corrected as shown below:

Column 3, Line 51 should read, $\sqrt{5d_1}$ instead of $\sqrt{5d_1}$

Column 6, Line 1, "hand" should read "hang."

Signed and Sealed this

*Twenty-eighth* Day of *June 1983*

[SEAL]

*Attest:*

GERALD J. MOSSINGHOFF

*Attesting Officer*

*Commissioner of Patents and Trademarks*